US007614348B2

(12) United States Patent
Truitt et al.

(10) Patent No.: US 7,614,348 B2
(45) Date of Patent: Nov. 10, 2009

(54) WEAPONS AND WEAPON COMPONENTS INCORPORATING REACTIVE MATERIALS

(75) Inventors: Richard M. Truitt, Champlin, MN (US); Daniel B. Nielson, Tremonton, UT (US); Benjamin N. Ashcroft, Perry, UT (US); Paul C. Braithwaite, Brigham City, UT (US); Michael T. Rose, Tremonton, UT (US); Mark A. Cvetnic, Chaska, MN (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 11/512,058

(22) Filed: Aug. 29, 2006

(65) Prior Publication Data

US 2009/0211484 A1 Aug. 27, 2009

(51) Int. Cl.
*F42B 12/22* (2006.01)

(52) U.S. Cl. ..... 102/491; 102/494; 102/496; 102/497; 102/506

(58) Field of Classification Search ..... 102/491, 102/494, 496, 497, 506
See application file for complete search history.

(56) References Cited

U.S. PATENT DOCUMENTS

| | | | | |
|---|---|---|---|---|
| 3,730,093 | A * | 5/1973 | Cummings | 102/363 |
| 3,951,068 | A | 4/1976 | Schroeder | |
| 3,961,576 | A * | 6/1976 | Montgomery, Jr. | 102/491 |
| 4,503,776 | A | 3/1985 | Nussbaum et al. | |
| 4,853,294 | A | 8/1989 | Everett et al. | |
| 5,049,212 | A | 9/1991 | Colick | |
| 5,313,890 | A * | 5/1994 | Cuadros | 102/496 |
| 5,535,679 | A * | 7/1996 | Craddock | 102/494 |
| 5,852,256 | A | 12/1998 | Hornig | |
| 6,293,201 | B1 | 9/2001 | Consaga | |
| 6,484,642 | B1 | 11/2002 | Kuhns et al. | |

(Continued)

FOREIGN PATENT DOCUMENTS

RU 2100763 C1 12/1997

OTHER PUBLICATIONS

U.S. Appl. No. 10/801,946, filed Mar. 15, 2004, entitled "Reactive Compositions Including Metal and Methods of Forming Same."

(Continued)

*Primary Examiner*—Bret Hayes
*Assistant Examiner*—Michael D David
(74) *Attorney, Agent, or Firm*—TraskBritt

(57) ABSTRACT

Weapons, weapon components and related methods are provided. In one embodiment a weapon component includes one or more discrete fragments embedded in a reactive material matrix. The weapon component may be used as a warhead that includes an explosive charge. In one embodiment the weapon component is configured such that, upon explosive launch, the reactive material matrix fractures to define one or more reactive material matrix fragments. The weapon component may be configured such that the discrete fragments are propelled at a first velocity over a defined distance while the reactive material matrix fragments are propelled at a second velocity over the defined distance, the second velocity being less than the first velocity. The weapon component may be used, for example, in a countermeasure weapon used to defeat a target weapon. Other embodiments of weapon components, weapons and related methods are also disclosed.

11 Claims, 6 Drawing Sheets

U.S. PATENT DOCUMENTS

| | | | | |
|---|---|---|---|---|
| 6,536,351 | B2 * | 3/2003 | Bocker et al. | 102/478 |
| 6,593,410 | B2 | 7/2003 | Nielson et al. | |
| 6,679,176 | B1 | 1/2004 | Zavitsanos et al. | |
| 6,832,740 | B1 * | 12/2004 | Ransom | 244/3.13 |
| 6,846,372 | B1 | 1/2005 | Guirguis | |
| 6,945,175 | B1 | 9/2005 | Gotzmer et al. | |
| 6,962,634 | B2 | 11/2005 | Nielson et al. | |
| 7,000,547 | B2 * | 2/2006 | Amick | 102/501 |
| 7,017,496 | B2 * | 3/2006 | Lloyd | 102/494 |
| 7,040,235 | B1 * | 5/2006 | Lloyd | 102/489 |
| 7,143,698 | B2 * | 12/2006 | Lloyd | 102/489 |
| 7,191,709 | B2 | 3/2007 | Nechitailo | |
| 7,194,961 | B1 * | 3/2007 | Nechitailo | 102/518 |
| 7,278,353 | B2 * | 10/2007 | Langan et al. | 102/306 |
| 7,278,354 | B1 * | 10/2007 | Langan et al. | 102/306 |
| 7,380,503 | B2 | 6/2008 | Williams et al. | |
| 2004/0020397 | A1 * | 2/2004 | Nielson et al. | 102/476 |
| 2005/0011395 | A1 * | 1/2005 | Langan et al. | 102/476 |
| 2005/0067072 | A1 | 3/2005 | Vavrick | |
| 2005/0199323 | A1 | 9/2005 | Nielson et al. | |
| 2006/0086279 | A1 * | 4/2006 | Lloyd | 102/497 |

OTHER PUBLICATIONS

3M Material Safety Data Sheet, pp. 1-7, Copyright 2005, 3M Company.

Indium Corporation of America, Europe and Asia, Indalloy Specialty Alloys, Mechanical Properties, as viewed at www.indium.com on Aug. 7, 2006.

Patriot Advanced Capability-3 (PAC-3), 17 pages, Various Dates, as viewed at http://www.missilethreat.com, on Nov. 27, 2006.

Patriot Air & Missile Defense System: How Patriot Works, http://static.howstuffworks,com, Copyright 2002 Raytheon Company.

Reactive Materials, Advanced Energetic Materials (2004), http://www.nap.com, Copyright 2004, 2001 The National Academy of Sciences, pp. 20-23.

Reactive Tungsten Alloy for Inert Warheads, Navy SBIR FY2004.2, 1 page.

The Ordnance Shop, Sidewinder Guided Missile, 3 pages, as viewed at http://www.ordnance.org on Jul. 26, 2006.

SpaceRef.com, Better Warheads Through Plastics, from Defense Advanced Research Projects Agency (DARPA), 2 pages, Dec. 2, 2002, http://www.spaceref.com.

Lycos, Wired News, Adding More Bang to Navy Missiles, 5 pages, Dec. 26, 2002, http://wired.com.

PCT International Search Report mailed Jul. 28, 2008, for International Application No. PCT/US2007/076672.

* cited by examiner

WEAPONS AND WEAPON COMPONENTS INCORPORATING REACTIVE MATERIALS

FIELD OF THE INVENTION

Embodiments of the present invention are related to weapons incorporating reactive materials and, more particularly, to weapons such as countermeasure weapons utilizing reactive materials to assist in defeating a target and also to related methods.

BACKGROUND OF THE INVENTION

Countermeasure weapons are often utilized to destroy or at least diminish the destructive capacity of another weapon so as to limit the potential destruction that may be otherwise inflicted by the other weapon. For example, it is desirable to destroy an incoming rocket or missile at a distant location, during the rocket's or missile's flight, so as to prevent the rocket or missile from reaching its intended target or even detonating near a location where damage or injuries might occur.

While numerous types of countermeasure weapons exist, as will be recognized by those of ordinary skill in the art, one specific example is a surface-to-air guided countermeasure missile utilized to defeat incoming missiles, rockets or other aerospace vehicles. A radar system is used to detect and track an incoming weapon or vehicle and even determine the type of incoming object. A control station, which may be manned or automated, is used to monitor incoming threats and make decisions regarding potential targets. The surface-to-air missile is launched upon command from the control station, which control station may be remotely located relative to the launcher. The missile is guided to the target that may include tracking the missile by radar, using homing sensors built in to the missile, or using a combination of both techniques. Various versions of surface-to-air missiles exist, and while they generally operate in a similar manner, they conventionally incorporate one of two different "kill mechanisms," or means of defeating the target weapon.

For example, one type of surface-to-air guided missile attempts to accomplish a dynamic defeat of its target by use of kinetic energy. In other words, this type of missile collides with its target in an attempt to detonate the target weapon prior to the target weapon reaching its intended destination. In another type of surface-to-air guided missile, the missile is guided toward its target weapon and, as it approaches the weapon, detonates a warhead and causes an explosion. The explosion of the missile is intended to either cause detonation of the target weapon or to at least change the course of the target weapon to prevent it from reaching its intended destination. The countermeasure missile may include the use of a fragmenting warhead such that fragments from the explosion impact the target weapon and provide the desired kinetic energy in an effort to defeat the target weapon.

Thus, each of these dynamic defeat mechanisms relies on kinetic energy to defeat to a substantial degree in their efforts to destroy the target weapon. However, such defeat mechanisms are not always completely reliable. One of the issues with reliance on kinetic energy as a kill mechanism, particularly if a fragmenting warhead is being utilized, is that it becomes difficult to design the countermeasure weapon since the charge to mass ratio for smaller diameter warheads becomes too low to accelerate the fragments to the velocity required to achieve a kinetic energy kill.

Thus, sometimes, even a kinetic energy "hit" of the target weapon by the countermeasure weapon fails to result in the complete destruction of the target weapon. Similarly, an explosion of a countermeasure weapon, whether using a fragmenting warhead or not, may not completely destroy the target weapon. Failure to completely destroy the target weapon may result in substantial injury or damage, either at the intended destination of the target weapon or at some other location, inflicted by the surviving portions or fragments of the target weapon.

In an effort to improve the likelihood of destroying a given target weapon, some attempts have been made to design a countermeasure weapon configured to have a kill mechanism that relies on both kinetic energy and chemical energy. It is intended that the chemical energy be released in the form of heat and pressure. Prototype warheads have been reported as producing fragments formed of a powdered metal embedded in a plastic matrix that survive an explosive launch typical of warhead fragmentation. The fragments are thus intended to provide kinetic energy, impacting the target weapon, and chemical energy through added heat and pressure as they react upon impact, in an attempt to destroy the target weapon.

However, it is a continuing goal to improve the efficiency and lethality of countermeasure weapons so as to provide a higher kill rate and ensure more complete destruction of a target weapon. It is also a continuing goal to improve the lethality of weapons while being provided in a design that is similar in size, or even reduced in size, to existing state of the art weapons. It would also be desirable to provide methods of making such weapons and improved methods of destroying a target weapon.

BRIEF SUMMARY OF THE INVENTION

One embodiment of the present invention comprises a weapon component that may be used in conjunction with a warhead or other munitions. The structure of the weapon component includes at least one discrete fragment disposed in a reactive material matrix, wherein the at least one discrete fragment and the reactive material matrix are cooperatively shaped into a reactive material fragmentation body.

Another embodiment of the present invention comprises a warhead. The warhead includes at least one discrete fragment disposed in a reactive material matrix. The at least one discrete fragment and the reactive material matrix are cooperatively shaped into a reactive material fragmentation body. An explosive charge is cooperatively configured in association with the reactive material fragmentation body to cause fragmentation of the reactive material matrix upon detonation of the explosive charge. A projectile, such as a missile incorporating an embodiment of a warhead of the present invention is also encompassed by the present invention.

Yet another embodiment of the present invention comprises a method of defeating a target weapon. The method includes positioning a warhead proximate the target weapon and detonating the warhead to propel a plurality of fragments therefrom. The target weapon is penetrated with at least a first fragment of the plurality of fragments so as to at least partially expose an interior portion of the target weapon. A chemical reaction is initiated, for example, at a location adjacent the target weapon subsequent the penetrating of the target weapon.

Yet another embodiment of the present invention comprises a method of explosively launching a warhead. The method includes positioning a warhead proximate the target weapon. The warhead is detonated and a plurality of fragments is propelled from the warhead so that the target weapon is penetrated with at least a first fragment of the plurality of fragments such that an interior portion of the target weapon is at least partially exposed. A chemical reaction is then initiated adjacent the target weapon subsequent to its penetration by a fragment.

Additional aspects of the present invention are disclosed herein and will be readily understood by those of ordinary skill in the art upon reading of the detailed description of the invention and the appended claims.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
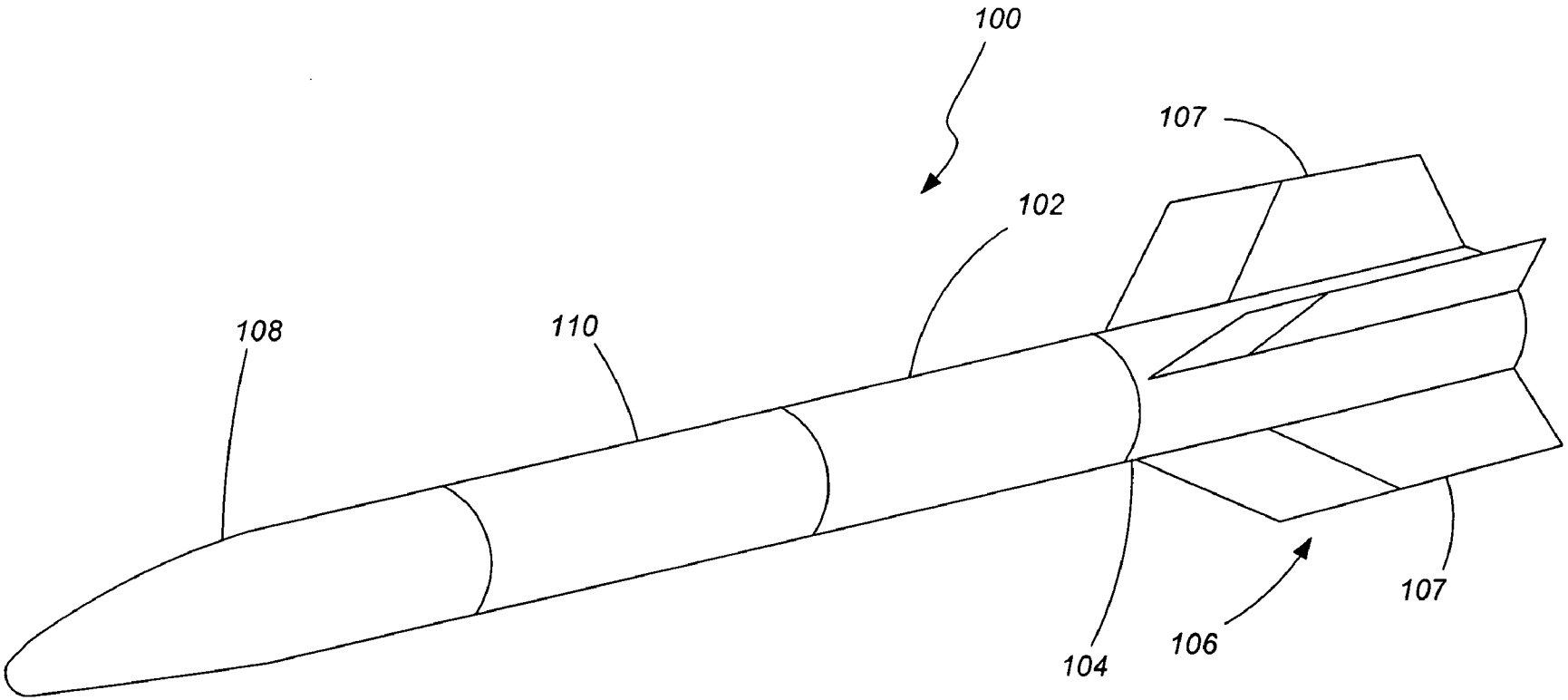
FIG. 1 is a perspective view of a countermeasure weapon in accordance with an embodiment of the present invention.

Referring to FIG. 1, a perspective view is shown of a countermeasure weapon 100 in accordance with an embodiment of the present invention. Various embodiments of the present invention provide a countermeasure weapon that provides improved lethality while being provided in a design that is similar in size, or even reduced in size, to existing state of the art countermeasure weapons. Additionally, certain embodiments of the present invention also provide methods of making such countermeasure weapons and improved methods of destroying a target weapon.

As shown in FIG. 1, in one embodiment, the weapon 100 may be configured as a rocket or missile and may include multiple sections or components. For example, the weapon 100 includes a rocket motor 102 containing a propellant (such as a liquid or a solid fuel, in one embodiment) and a nozzle (neither shown in detail) that are cooperatively configured to produce a desired thrust and propel the weapon 100. The weapon 100 may further include a tail section 104 including a wing or fin assembly 106 configured to assist in controlling the flight pattern of the weapon 100. In one embodiment, the fin assembly 106 includes a plurality of adjustable fins 107 to selectively alter the course of flight of the weapon 100. In another embodiment, the nozzle (or nozzles—not shown) associated with the rocket motor 102 may be adjustable so as to selectively alter the course of flight of the weapon 100. While not specifically depicted, a rolleron assembly or other stabilizing structure may be associated, for example, with the fin assembly 106, to stabilize the weapon 100 during flight as will be appreciated by those of ordinary skill in the art.

The weapon 100 may also include a forward or nose section 108 that may house a guidance/control system configured to direct the weapon 100 along a desired flight path such as by controlling the fin assembly 106, the one or more nozzles associated with the rocket motor 102, or both. The control system may include various sensors that may be used in detecting a target weapon and, further may include communication equipment configured to transmit and receive information related to the flight or status of the weapon 100 as well as information gathered relating to a target weapon. Additionally, the weapon may include a warhead 110 that is configured to be detonated at a specific time in an effort to defeat a target weapon. Depending on the desired use of the weapon 100, the warhead 110 may be configured to detonate upon impact of the weapon 100 with a target weapon 100, or it may be configured to be detonated at a desired time, such as when the weapon 100 is located within a desired distance of a target weapon. In the case of the latter, the control system may include or be associated with appropriate detonating equipment to effect the desired detonation of the warhead 110 as will be appreciated by those of ordinary skill in the art.

It is noted that the weapon 100 depicted in FIG. 1 is merely an example and that the various components (e.g., rocket motor 102, fin assembly 106, warhead 110, etc.) need not be arranged in the specific order or configuration depicted in FIG. 1. Additionally, the weapon 100 may be configured or altered in a variety of ways depending on the intended use of the weapon 100. For example, the weapon 100 may be configured as a mobile-launched aerial-intercept missile (MIM), as an air-launched aerial-intercept missile (AIM), or as any of a number of other weapons as will be appreciated by those of ordinary skill in the art.

Figure 2A:
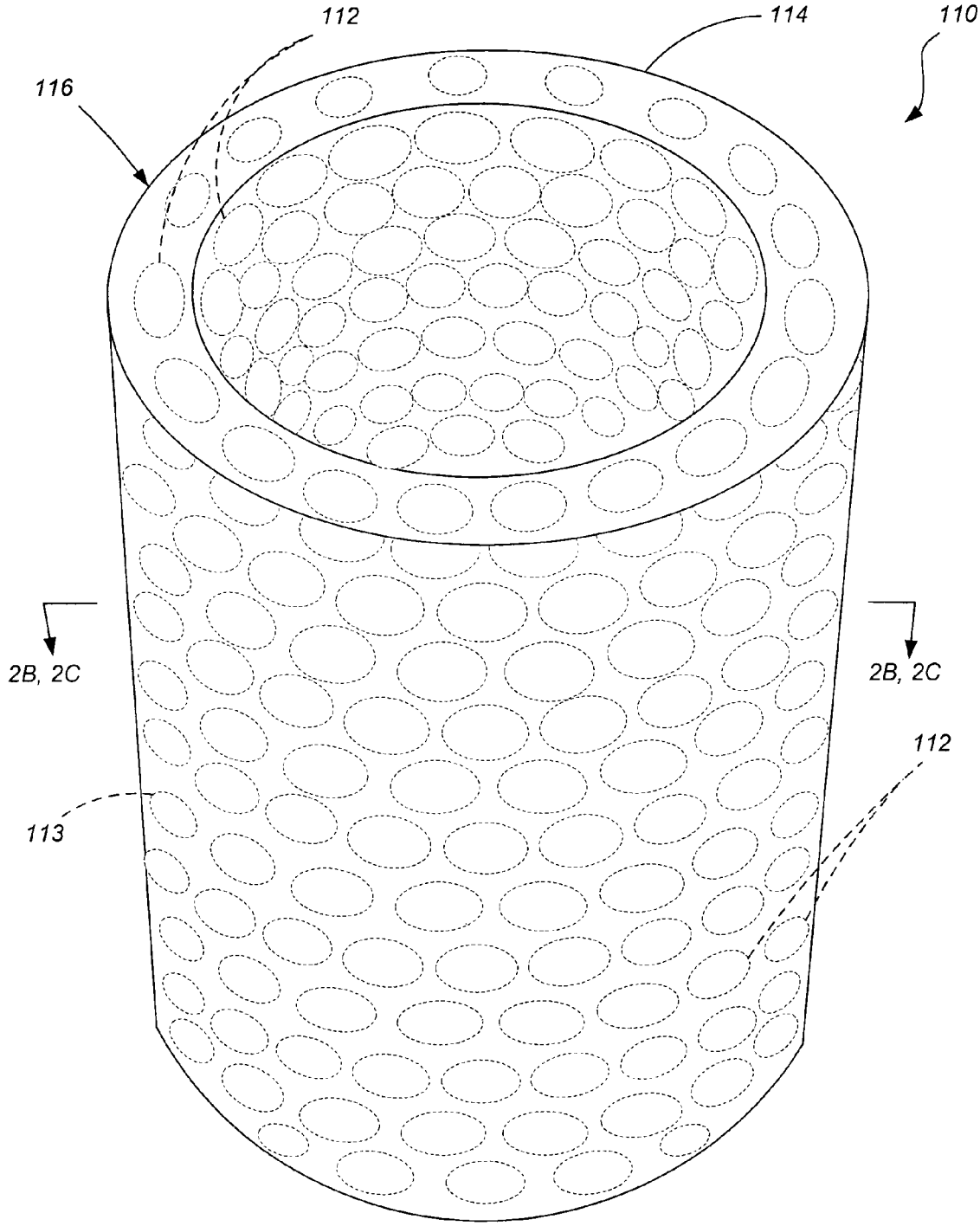
FIG. 2A is perspective view of a warhead for use in a countermeasure weapon in accordance with an embodiment of the present invention.

Referring to FIG. 2A, a perspective view is shown of a warhead 110 that may be used in conjunction with the weapon 100 of the present invention in accordance with one embodiment thereof. The warhead 110 includes a plurality of preformed, discrete fragments 112 (shown in dashed lines in FIG. 2A) that may be formed of an inert material, a reactive material or a combination of both inert and reactive materials as will be discussed in the further detail below.

The discrete fragments 112 are embedded or otherwise disposed in a reactive material matrix 114. The reactive material matrix 114 may include a castable energetic material capable of producing, for example, intermetallic, thermitic or more conventional fuel/oxidizer reactions. The reactive material matrix 114 further exhibits physical properties designed to hold the discrete fragments 112 and maintain a desired geometric shape, the discrete fragments 112 and the reactive material matrix 114 cooperatively defining a reactive material fragmentation body 116. While not shown in FIG. 2A for purposes of convenience and clarity, the warhead 110 further includes an explosive charge 118 (see FIGS. 2B and 2C) which, for example, may be disposed within an interior portion of the warhead 110 defined by the reactive material fragmentation body 116.

Figure 2B:
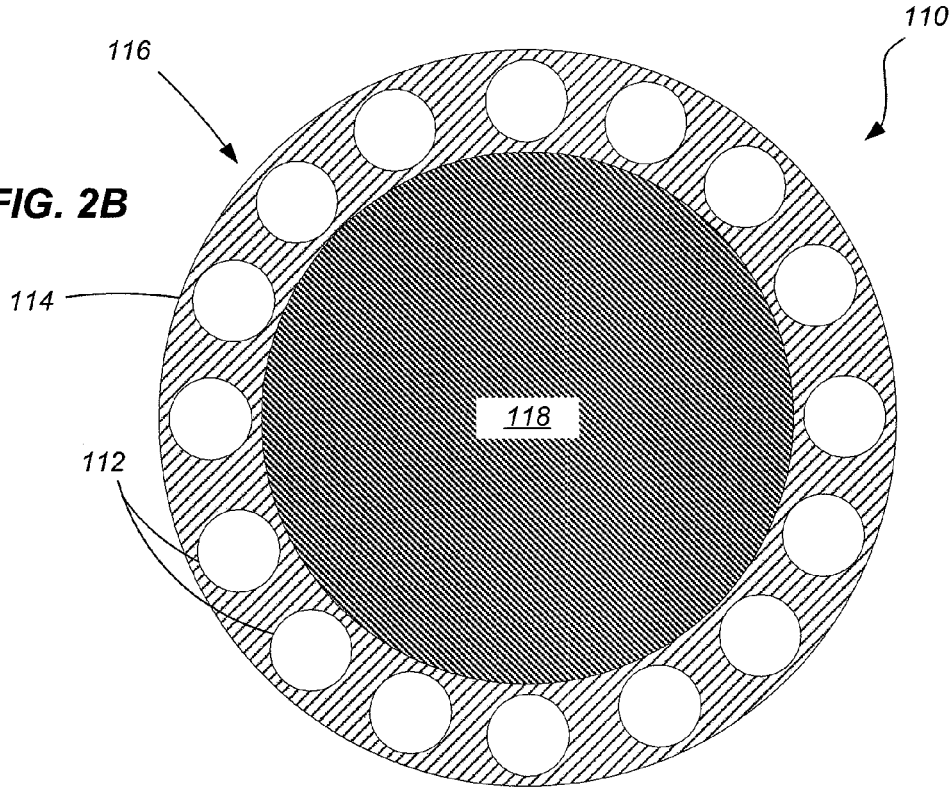
FIG. 2B is a cross-sectional view of the warhead of FIG. 2 in accordance with one embodiment of the present invention.
Figure 2C:
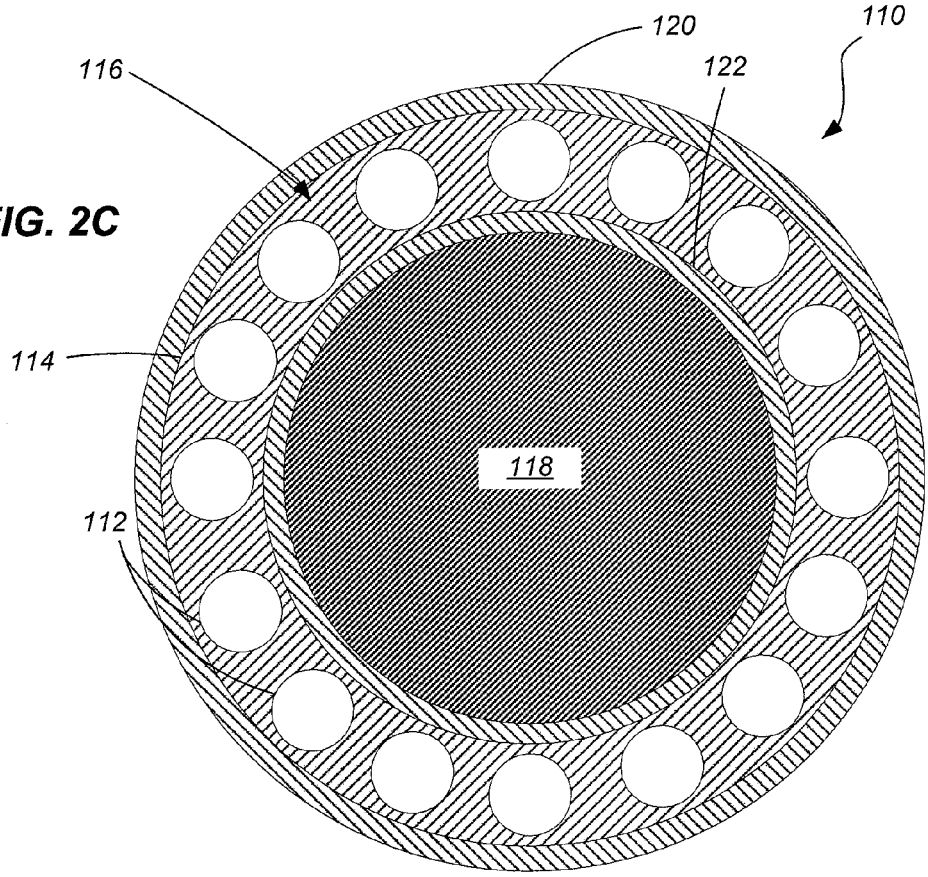
FIG. 2C is a cross-sectional view of the warhead of FIG. 2 in accordance with another embodiment of the present invention.

As seen FIG. 2B, the reactive material fragmentation body 116 may be configured such that the reactive material matrix 114 is substantially unbuffered or, in other words, exposed to an external or ambient environment. Similarly, the reactive material matrix 114 may be substantially "unbuffered" with respect to its exposure to the explosive charge 118. In another embodiment, such as shown in FIG. 2C, a casing or barrier layer 120 may be disposed about the exterior portion of the reactive material fragmentation body 116 and, similarly, a casing or barrier layer 122 may be disposed between the reactive material fragmentation body 116 and the explosive charge 118. In one example, one or more of the barrier layers may be formed of a metallic material, such as aluminum. In another embodiment, one or more of the barrier layers may be formed of a composite material including, for example, a fiber reinforced composite structure.

Figure 3A:
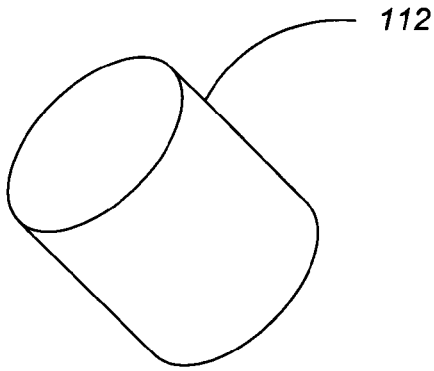
FIGS. 3A-3D are perspective views of various embodiments of fragments utilized in accordance with various embodiments of the present invention.
Figure 3B:
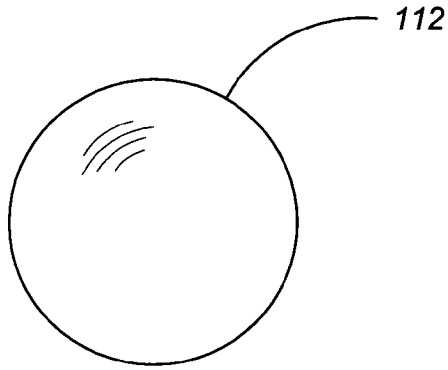
Figure 3C:
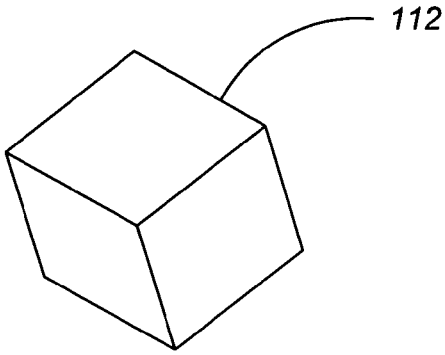

Referring briefly to FIGS. 3A and 3C, the discrete fragments 112 may be formed to exhibit any of a variety of geometric configurations. For example, in one embodiment, the discrete fragments 112 may exhibit a substantially cylindrical geometric configuration (i.e., FIG. 3A), while in another embodiment the discrete fragments 112 may exhibit a substantially spherical geometric configuration (FIG. 3B), while in yet a further embodiment, the discrete fragments 112 may exhibit a substantially cubic configuration (FIG. 3C). Of course such embodiments shown in FIGS. 3A-3C are merely examples and other geometric configurations, including discs, annular members, cones, pyramids, prisms or complex geometries, may be used.

The discrete fragments 112 utilized in a given reactive material fragmentation body 116 may each exhibit substantially the same geometric configuration or they may exhibit multiple, different geometric configurations. Additionally, the discrete fragments 112 utilized in a given reactive material fragmentation body 116 may each be similarly configured with respect to material composition or they may include multiple fragments 112 that are configured from different material compositions, including inert and reactive material compositions.

Figure 3D:
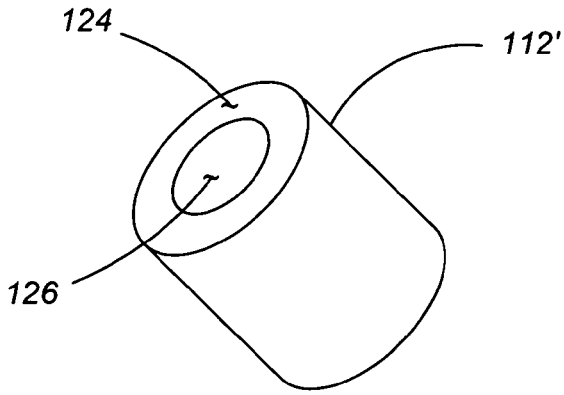

The discrete fragments 112 may further be configured as substantially monolithic, homogenous structures, or they may be formed as composite structures being formed of multiple components. Additionally, the discrete fragments 112 may be formed from inert materials, reactive materials, or both. For example, the discrete fragments 112 depicted with respect to FIGS. 3A and 3B may be formed of a substantially homogeneous inert material or of a substantially homogenous reactive material. In another embodiment, and referring briefly to FIG. 3D, a discrete fragment 112' may be formed from multiple components such as a first inert material 124 and a second reactive material 126 disposed in one or more cavities or perforations formed in the discrete fragment 112'. Another embodiment might include an inert material coated with a reactive material. Other embodiments may include two or more inert materials, wherein, for example, the various materials differ in hardness or some other mechanical property. In yet other embodiments, two or more reactive materials may be used to form the discrete fragment 112', wherein, for example, the various materials may exhibit different types of reactions or different levels of reactivity. Other variations of materials used to form the discrete fragments 112' are also contemplated.

Still referring to FIGS. 2A-2C, another embodiment of the present invention may include one or more discrete fragments 112 disposed in a matrix material (e.g., reactive material matrix 114) that are formed of a first material, such as an inert material, as well as one or more discrete fragments 113 disposed in a matrix material that include a second material, such as a reactive material. In such a case, the material matrix 114 may be formed of a reactive material or of an inert material.

Figure 4:
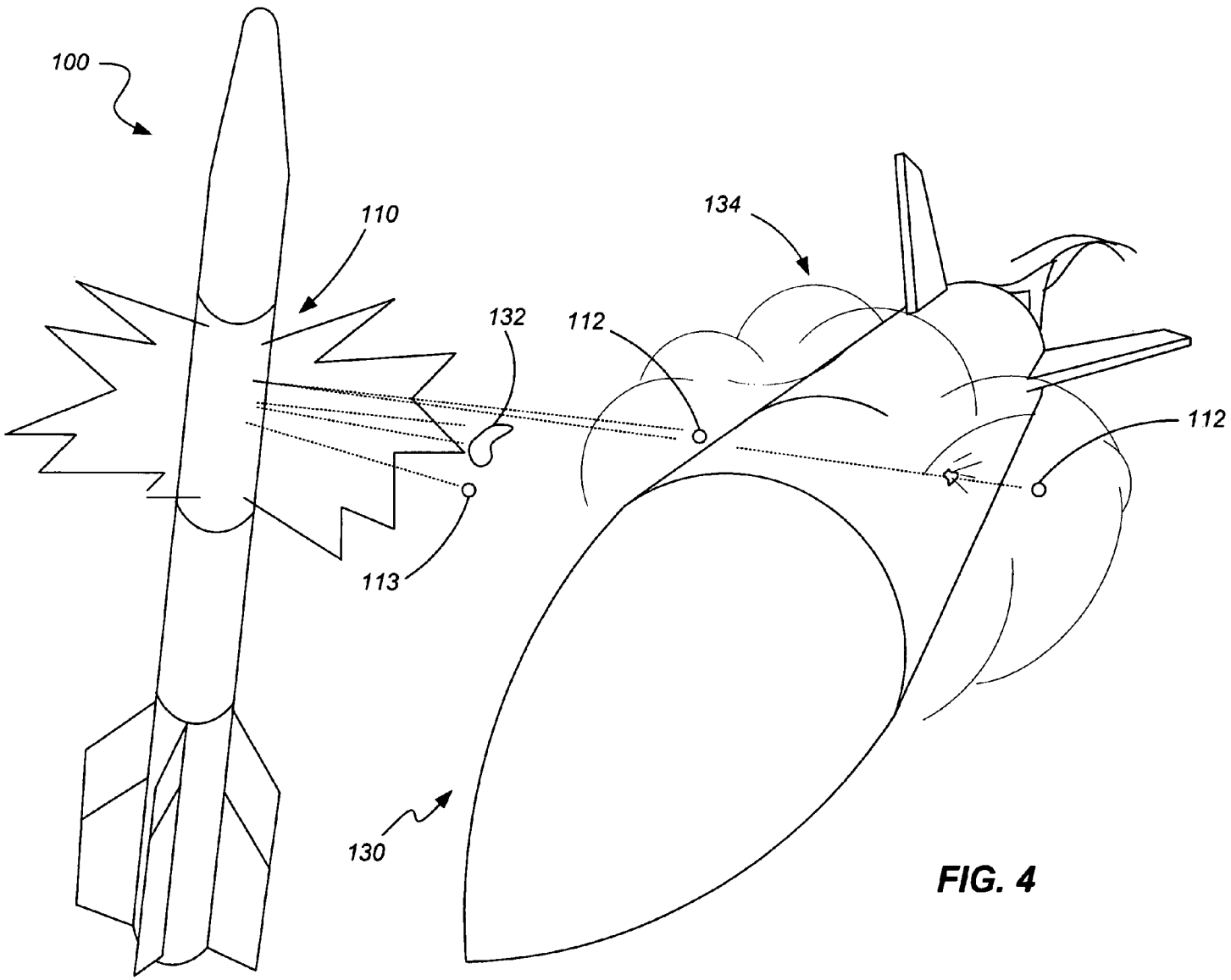
FIG. 4 is an illustration of a countermeasure weapon utilized to defeat a target weapon in accordance with an embodiment of the present invention.

Referring now to FIG. 4 in conjunction with FIGS. 1 through 3C, use of the warhead 110 to defeat a target weapon 130 is now described. The countermeasure weapon 100 is guided to a location proximate the target weapon 130 using guidance and control systems as will be appreciated by those of ordinary skill in the art. Upon reaching a desired proximity to the target weapon 130, the warhead 110 experiences what may be referred to as an "explosive launch" by detonation of the explosive charge 118. The explosion of the explosive charge 118 results in the fracturing, fragmentation and comminution of the reactive material fragmentation body 116 to form numerous individual reactive material matrix fragments 132 (only one shown in FIG. 4 for sake of convenience and clarity). The discrete fragments 112 and the reactive material matrix fragments 132 are all propelled outwardly from the countermeasure weapon 100, with numerous fragments 112 and 132 being propelled towards the target weapon 130. However, the discrete fragments 112 are specifically configured to travel at a higher velocity, over a defined distance, as compared to the reactive material matrix fragments 132, based on, for example, the comparative ballistic drag of such fragments 112 and 132.

As will be appreciated by those of ordinary skill in the art, various factors are taken into account with regard to the ballistic drag of the discrete fragments 112 as compared to the ballistic drag of the reactive material matrix fragments 132. For example, the velocity differential over a defined distance may be influenced by the geometric configuration of the discrete fragments 112; by the packing arrangement of the discrete fragments 112 within the reactive material matrix 114 prior to explosive launch; by the density of the discrete fragments 112 relative to the material used for the reactive material matrix 114; by the comparative surface areas of the discrete fragments 112 and the reactive material matrix fragments 132; by the comparative roughness of the surfaces of the discrete fragments 112 and the reactive material matrix fragments 132; by other factors and various combinations of the above-listed examples of factors.

It is noted that, in certain embodiments, the reactive material matrix fragments 132 will actually have a higher initial velocity than will the discrete fragments 112. However, as already discussed hereinabove, based on various factors that influence the ballistic drag of the various fragments 112 and 132, the discrete fragments 112 may be designed to have a higher velocity over a defined distance than that which is exhibited by the reactive material matrix fragments 132.

With the discrete fragments 112 traveling at a higher velocity (over the defined distance) than the reactive material matrix fragments 132, the discrete fragments 112 reach the target weapon first and utilize their kinetic energy to penetrate the target weapon 130. Besides other damage that might be inflicted by the discrete fragments 112, the penetration of the target weapon 130 causes material (including, for example, explosive, incendiary, reactive, or biological material) to be released from the target weapon 130 in a particulate cloud 134. The reactive material matrix fragments 132 subsequently reach the target weapon 130 and react, such as upon impact therewith. The reaction of the reactive material matrix fragments 132 may produce additional heat, additional pressure, or both, depending on the specific composition of the reactive material being used. Additionally, the added heat, pressure, or combination of both may further cause the material forming the particulate cloud 134 to react such that, for example, the particulate cloud 134 and the remaining material within the target weapon 130 burns or explodes, thereby destroying the target weapon 130.

Thus, the warhead 110 utilizes both kinetic energy and chemical energy, in a controlled and ordered manner, to effect a dynamic defeat of the target weapon 130. It is noted that the discrete fragments 112 and the reactive material matrix 114 (and thus the reactive material matrix fragments 132) may be specifically designed to provide a predetermined velocity differential. For example, selection of the materials used in forming the discrete fragments 112 and the reactive material matrix 114 may result in a density difference between such components, thereby affecting the relative kinetic and dynamic characteristics of the discrete fragments 112 and the reactive material matrix fragments 132. Additionally, as noted hereinabove, the discrete fragments 112 may be geometrically configured to provide enhanced aerodynamic properties as compared to the reactive material matrix fragments 132. In other words, the discrete fragments 112 may experience less aerodynamic drag than the reactive material matrix fragments 132.

The reactive material fragmentation body 116 may further be configured to promote a substantially controlled break-up of the reactive material matrix 114 upon explosive launch such that the reactive material matrix fragments 132 are of a desired shape, a desired size or both. For example, while not specifically shown, the reactive material fragmentation body 116 may include a pattern of scores, kerfs, notches or grooves to promote a patterned break-up of the reactive material matrix 114. Additionally, or alternatively, the packing arrangement of the discrete fragments 112 within the reactive material matrix 114 may be configured to promote a desired break-up of the reactive material matrix 114.

Referring more specifically to FIG. 2A and FIG. 4, in another embodiment, if two types of discrete fragments 112 and 113 are utilized, such discrete fragments 112 and 113 may also be configured to exhibit a velocity differential upon explosive launch thereof responsive to detonation of the warhead 110. For example, a first type of discrete fragment 112 might be formed of an inert material and exhibit a first velocity characteristic, while a second type of discrete fragment 113 may include a reactive material and exhibit a second velocity that is lesser or slower than the first velocity. This will enable the first type of discrete fragment 112 to reach a target weapon 130 and utilize its kinetic energy to penetrate the target weapon 130 as discussed hereinabove, while the second type of discrete fragment 113 may subsequently reach the target weapon 130 and cause a reaction such that the particulate cloud 134 and the remaining material within the target weapon 130 burns or explodes, as has been previously discussed.

Of course various combinations and variations of such embodiments may be utilized, including a discrete fragment 112' that includes a reactive material or various combinations of discrete fragments 112, 112' and 113 with or without reactive material matrix fragments 132.

Figure 5:
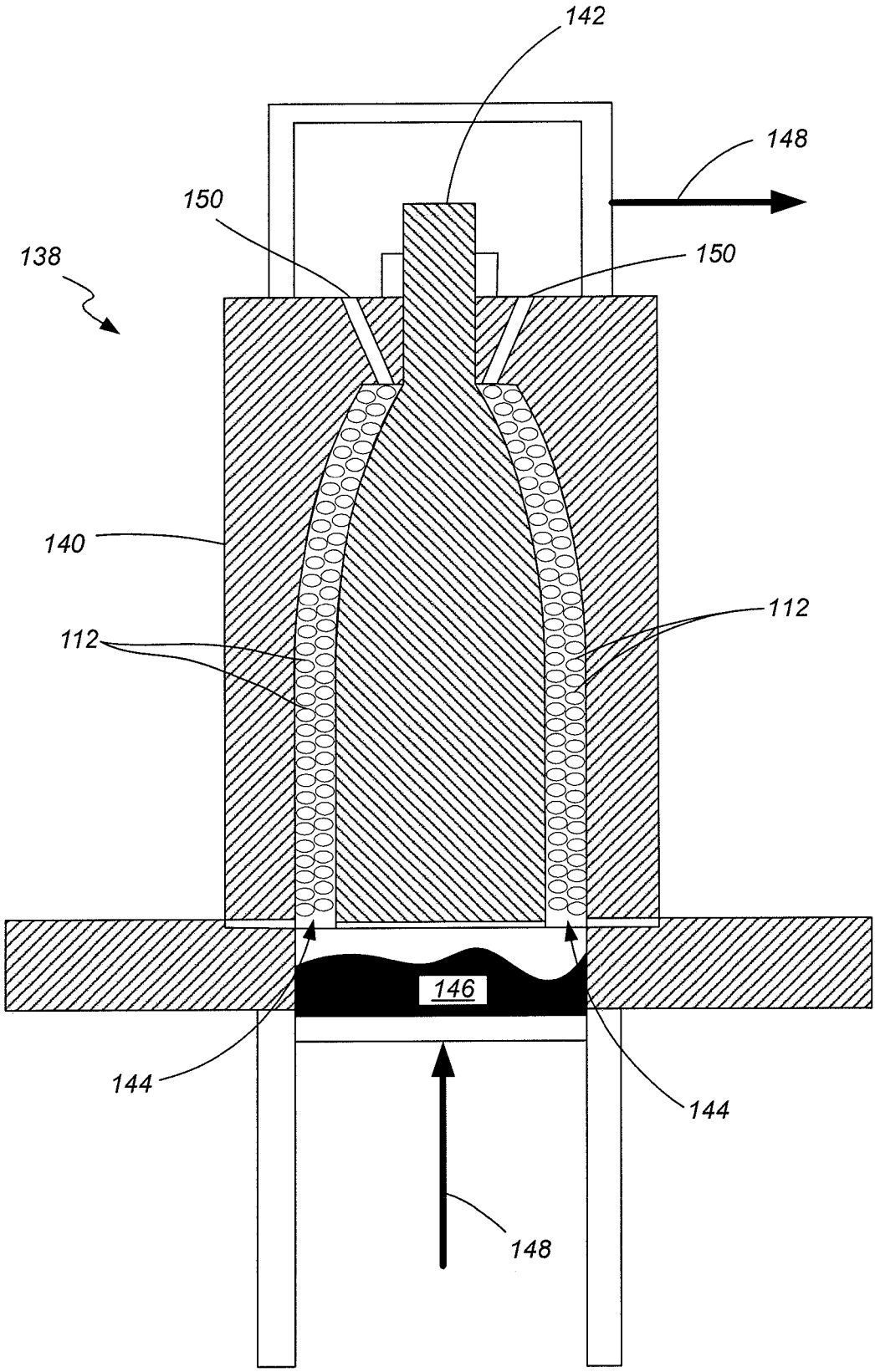
FIG. 5 is partial cross-sectional view of a portion of a warhead and associated fabrication equipment in accordance with an embodiment of the present invention.

A reactive material fragmentation body 116 such as has been described herein may be formed by various methods or processes. For example, a reactive material fragmentation body 116 may be formed using casting, extruding, injection loading techniques or other processes as will be appreciated by those of ordinary skill in the art. Referring to FIG. 5, a schematic is shown regarding one example of a casting process that may be used to prepare a reactive material fragmentation body 116 in accordance with an embodiment of the present invention.

Mold tooling 138 used to fabricate a reactive material fragmentation body 116 (FIG. 2A) may include a case 140 and a core 142. The case 140 and core 142 may be configured and positioned so as to form a gap or a space 144 between the two tooling components. A plurality of discrete fragments 112 is disposed within the gap or space 144. Reactive material 146 is cast through the discrete fragments 112 disposed in the gap or space 144 by means of pressure (as schematically indicated by arrows 148). One or more vent ports 150 are formed in the mold tooling 138 (e.g., the case 140) to enable air to escape from the mold tooling 138 during the casting process. Such a process enables the formation of a reactive material fragmentation body 116 wherein a plurality of discrete fragments 112 is disposed in a matrix material such as a reactive material matrix 114 (FIG. 2A).

A reactive material fragmentation body 116 may be formed from numerous types of materials. For example, as set forth hereinabove, the discrete fragments 112 may be formed of either inert material, reactive material, or as a composite of both inert and reactive materials. In one embodiment, the discrete fragments may be formed, for example, as steel or tungsten shot or bearings (i.e., spherical members). In another embodiment, other metals, including alloys of such metals may be used to form the discrete fragments 112.

Additionally, the reactive material matrix 114 may be formed of any of a number of materials. Generally, in one embodiment, the reactive material may comprise at least one material comprising a fuel and at least one material comprising an oxidizer. In another embodiment, thermites with binders may be utilized. In a further embodiment, intermetallics with binders may be utilized.

Examples of thermitic compositions that may be used include, without limitation, the following: $2Al+Bi_2O_3$, $2Al+3CuO$, $2Al+Fe_2O_3$, $10Al+3I_2O_5$, $2Al+Ni_2O_3$, $4Al+3SiO_2$, $4Al+3SnO_2$, $4Al+3WO_2$, $2B+3CuO$, $Hf+2CuO$, $3Hf+2Fe_2O_3$, $2Hf+Fe_3O_4$, $2Ta+5CuO$, $Zr+2CuO$, and $3Zr+2Fe_2O_3$.

Examples of intermetallic compositions that may be used include, without limitation, the following: Al+2B, 2Al+Ca, Al+Co, 5 μl+2Co, Al+Fe, 3 Al+Fe, Al+Ni, Al+3Ni, Al+Pd, Al+Pt, 2 μl+3S, Al+Ti, 2Al+Ti, 2Al+Zr, 6B+Ce, 2B+Cr, 2B+Hf, 6B+La, 2B+Mn, 2B+Mo, 2B+Nb, 6B+Sm, 2B+Ta, 4B+Th, B+Ti, 2B+Ti, 2B+U, 4B+U, B+V, 2B+V, 5B+2W, 2B+Zr, 3Ba+2Bi, 2Ba+Sn, Be+2C, 2Be+C, 5Be+Nb, C+Hf, 0.98C+Nb, C+Nb, C+2B, C+Si, C+Ta, 1.94C+Th, 2C+Th, C+Ti, C+U, 2C+U, C+V, C+Zr, Ca+Si, 2Ca+Sn, Ce+2Si, Ce+Zn, Co+Si, 5Cr, 3Si, Fe, +Si, Mg+S, Mg+Se, Mg+U, 5Nb+3Si, Ni+Si, Pd+Sn, S+Zn, 2Si+Ta, 3Si, +5Ti, 2Si, +V, 2Si+W, Si+Y, Si+2Zr, 2Si+Zr, 3Si+5Zr, 2Zn+Zr.

In accordance with one embodiment of the invention, the thermite or intermetallic composition may be loaded into a castable fluoropolymer binder. One example of a suitable binder includes perfluorosuccinyl polyether di-alcohol (a castable binder known by the designation L9939 and available from 3M Company of St. Paul, Minn.) that is cured with isocyanate DESMODOR® N-100 or N-3200 and a trace of dibutyl tin diacetate. Another example of a suitable binder includes a castable nonfluorinated hydroxyl terminated polymer of triethylene glycol succinate, (a binder commercially known as Witco 1780 and available from Chemtura Corporation of Middlebury, Conn.) that is cured with N,N-diglycidyl-4-glycidyloxybenzenamine (an epoxy, commercially known as ERL 0510) and catalyzed with a metal linoleate such as iron linoleate or octoate.

Other examples of suitable binders include inert thermoplastic polymers such as ethylethacrylate, polyamide (nylon), polyester, polyethylene, polypropylene, polystyrene, polycarbonate, polyacrylates, polyvinyl chloride (PVC), acrylonitrile-butadiene-styrene (ABS), fluorinated thermoplastic polymers such as terpolymers of tetrafluorethylene, hexafluoropropylene and vinylidenedifluoride (THV) including those commercially known by the designations of THV 220 and THV 500, and polyvinyl alcohol (PVA). Additionally, thermoset resins or polymers may be used including, for example, silicone, phenolic, polyester, polyurethane, melamine formaldehyde resins, polysulfide, epoxies, acrylates, fluoropolymers and polyimides.

Other materials that may be used to form the reactive material matrix 114 include low-melting point metal alloys. For example, a fusible metal alloy known as INDALLOY® 174, that has 57% Bi, 26% In, and 17% Sn (percentages indicated herein are percentages by weight unless stated otherwise). INDALLOY® 174 has a melting point of 174° F. (approximately 79° C.), a density of 8.54 grams per cubic centimeter (g/cm$^3$), and is commercially available from Indium Corp. of America (Utica, N. Y.). Another example of a metal alloy that may be used includes INDALLOY® 224 that has 52.2% In, 46% SN and 1.8% Zn. INDALLOY® 224 has a melting point of 226° F. (approximately 108° C.) a density of 7.27 g/cm$^3$ and is also commercially available from Indium Corp. of America.

Low-melting point metal alloys can be used by themselves as the reactive material matrix 114, or they may be mixed with oxidizers such as, for example, potassium perchlorate, ammonium perchlorate, ammonium nitrate, potassium nitrate, cesium nitrate, strontium peroxide, barium peroxide, cupric oxide, basic copper nitrate (BCN), as well as with compositions that produce intermetallic or thermitic reactions such as have been described hereinabove.

It is believed that use of materials that exhibit low melting points to form the reactive material matrix 114, such as the low-melting point metal alloys and the thermoplastic polymers discussed hereinabove, will greatly improve the insensitive-munitions properties of the associated warheads 110 as compared to conventional warheads. Such a benefit is believed to result from the pressure relief provided to the warhead 110 while it is in slow cook-off environments due to the softening and flow of the reactive material matrix 114 as it heats up to its melting point.

It is additionally noted that the above materials, described as examples that may be used in conjunction with the reactive material matrix 114, may also be used as reactive materials associated with discrete fragments (e.g., 112' or 113). Additional examples of reactive materials that may be used in conjunction with various embodiments of the present invention (in conjunction with either the reactive material matrix or in association with discrete fragments) include those disclosed in U.S. patent application Ser. No. 10/801,946 filed on Mar. 15, 2004 (entitled REACTIVE COMPOSITIONS INCLUDING METAL), U.S. patent application Ser. No. 10/801,948 filed on Mar. 15, 2004 (entitled REACTIVE MATERIAL ENHANCED MUNITION COMPOSITIONS AND PROJECTILES CONTAINING SAME), and U.S. Pat. No. 6,962,634 issued Nov. 8, 2005 (entitled LOW TEMPERATURE, EXTRUDABLE, HIGH DENSITY REACTIVE MATERIALS), the disclosures of each of which documents are incorporated by reference herein in their entireties.

Yet another material that may be used as a reactive material (e.g., either as the reactive material matrix 114 or as a component of one of the discrete fragments 112' or 113) includes a composition containing a mixture of approximately 50% W (90 micron powder tungsten), approximately 21.43% W (6to 8 micron powder tungsten), approximately 9.99% KP (20 micron powder potassium perchlorate), approximately 9.99% Zr (325 mesh zirconium), approximately 4.42% of an epoxy commercially known as ARALDITE® LY 1556 (available from Huntsman Corp. of Salt Lake City, Utah), approximately 3.98% of an anhydride hardener commercially known as ARADUR® 917 (available from Huntsman Corp.), approximately 0.023% of an amine accelerator commercially known as DY070 (available from Huntsman Corp.) and approximately 0.171% of a fumed silica commercially known as CAB-O-SIL® TS720 (available from Cabot Corp. of Albuquerque, N. Mex.).

Weapons 100 and warheads 110 provided in accordance with various embodiments of the present invention offer numerous advantages including increased efficiency in defeating a target weapon by utilizing both kinetic and chemical energy. Additionally, weapons in accordance with various embodiments of the present invention enable smaller, more maneuverable countermeasure weapons to be utilized and the charge-to-mass ratio of such a weapon may be reduced.

It is noted that various weapons and munitions may be manufactured and utilized in accordance with one or more aspects of the present invention. Various embodiments of the present invention may include fragmentary warheads, rockets and missiles incorporating such warheads, fragmentary medium caliber munitions, unmanned vehicles, structural components in such unmanned vehicles, reactive projectiles and bullets, or other various types of weapons and munitions. As such, it will be recognized by those of ordinary skill in the art, that while described as a substantially cylindrical warhead hereinabove, that the present invention may take the form of various shapes including, for example, pucks, discs, balls or spheres, plates, prisms, annular shapes, cones, pyramids or various other shapes including complex shapes. Additionally, the warhead 110, or any other weapon formed in accordance with various embodiments of the present invention, may be configured to disperse the discrete fragments 112 in a substantially omnidirectional pattern or in a defined or focused directional pattern.

EXAMPLE 1

Referring generally to FIGS. 2A-2C, a warhead 110 was formed having an overall length of approximately 9 inches and an outer diameter of approximately 2.75 inches. The reactive material fragmentation body 116 included approximately 744 discrete fragments 112 disposed in a reactive material matrix 114. The discrete fragments 112 were formed of tungsten, each having a mass of approximately 73 grains and exhibiting substantially spherical geometries of approximately 0.3125 inch. The reactive material matrix 114 was formed of a composition including approximately 42% Ni (nickel), 22% Al (aluminum), 20% KP (potassium perchlorate) and approximately 16% of an epoxy designated as UF-3323, which is available from Alliant Techsystems of Edina, Minn.

An explosive charge 118, including a 792 gram mass of DLE-C038E explosive material that exhibited a diameter of approximately 1.92 inches was disposed within the reactive material fragmentation body 116. The explosive material known as DLE-C038 includes 90% 2,4,6,8,10,12-hexanitrohexaazaisowurtzitane (CL-20) and 10% hydroxyl-terminaterd polybutadiene (HTPB). The warhead included an outer barrier (i.e., barrier layer 120) comprising aluminum and exhibiting a radial thickness of approximately 0.020 inch, and an inner barrier (i.e., barrier layer 122) comprising aluminum and exhibiting a radial thickness of approximately 0.040 inch.

The warhead 110 was tested by positioning it approximately 1 meter (m) off of the ground and then positioning three different mortars and three different witness panels about the warhead 110. Three mortars were used that contained Comp B explosive material. Comp B explosive material includes approximately 59% to 59.5% RDX (cyclo-1,3,5-trimethylene-2,4,6-trinitramine, also known as hexogen or cyclonite), approximately 39% to 39.5% TNT (trinitrotoluene) and approximately 1% wax. The first mortar was positioned approximately 39.5 inches from the warhead 110, approximately 37 inches above the ground, and was oriented substantially vertically. A second mortar was positioned approximately 39.5 inches from the warhead 110, approximately 37 inches above the ground, and was oriented substantially horizontally. A third mortar was positioned approximately 58.5 inches from the warhead 110, approximately 35 inches above the ground, and was oriented at an angle of approximately 45°. The warhead 110, mortars and three witness panels were arranged such that, upon explosive launch of the warhead 110, fragments (both discrete and those formed from the fractured and comminuted reactive material matrix) would travel toward each of the target mortars and witness panels. The three witness panels were arranged so as to inspect and analyze the fragment patterns subsequent the explosive launch of the warhead 110. One of the witness panels was positioned approximately 1.0 m away from the warhead 110, another was positioned approximately 1.5 m from the warhead 110, and the last witness panel was positioned approximately 2.0 m away from the warhead 110.

Equipment used to record and analyze the explosive launch of the warhead 110 included a hi-speed video camera that was capable of recording at 26,000 frames per second with a 10 microsecond exposure. Additionally, a digital video camera capable of recording at 30 frames per second and a VHS camera capable of recording at 30 frames per second were utilized.

It was determined that explosive launch of the warhead 110 resulted in the discrete fragments traveling at an average velocity of approximately 3,800 feet per second (or approximately 2,591 miles per hour) over a distance of approximately 1.0 m. It was observed that the velocity differential between discrete fragments and reactive material matrix fragments was approximately 5 to 10 milliseconds as such fragments traveled from the warhead 110 to the various targets.

The first mortar (oriented substantially vertically) was penetrated by six fragments that resulted in the complete burn-out of the explosive contained by the mortar and, therefore, was considered a "kill" or defeat of the mortar. The second mortar (oriented substantially horizontally) was completely broken apart. The third mortar (at an extended distance from the warhead 110, compared to the first two mortars, and oriented at an angle of approximately 45°) was likewise defeated with the mortar being fragmented.

EXAMPLE 2

Again referring generally to FIGS. 2A-2C, a warhead 110 was formed having an overall length of approximately 9 inches and an outer diameter of approximately 3.55 inches. The reactive material fragmentation body 116 included approximately 698 discrete fragments 112 disposed in a reactive material matrix 114. The discrete fragments 112 were formed of steel, each having a mass of approximately 73 grains and exhibiting substantially spherical geometries of approximately 0.3125 inch. The reactive material matrix 114 was formed of a composition including approximately 38.5% CuO (cupric oxide), 45.2% Zr (zirconium) and approximately 16.3% of an epoxy.

An explosive charge 118, including a 1245 gram mass of DLE-C038E explosive material that exhibited a diameter of approximately 2.71 inches was disposed within the reactive material fragmentation body 116. The warhead 110 included an outer barrier (i.e., barrier layer 120) comprising aluminum and exhibiting a radial thickness of approximately 0.020 inch, and an inner barrier (i.e., barrier layer 122) comprising aluminum and exhibiting a radial thickness of approximately 0.040 inch.

The warhead 110 was tested by positioning it approximately 1 meter (m) off of the ground and then positioning four different witness plates at locations of approximately 2.0 m from the warhead 110. The four witness plates exhibited relative thicknesses of approximately 0.125 inch, 0.25 inch, 0.375 inch and 0.5 inch.

Equipment used to record and analyze the explosive launch of the warhead 110 included a hi-speed video camera that was capable of recording at 20,000 frames per second with a 10 microsecond exposure. Additionally, a VHS camera capable of recording at 30 frames per second was utilized along with two PCB® blast gauges.

It was determined that explosive launch of the warhead 110 resulted in the discrete fragments traveling at an average velocity of approximately 4,050 feet per second (or approximately 2,761 miles per hour) over a distance of approximately 2.0 m.

The witness plates each exhibited penetration by the discrete fragments 112 indicating substantial potential for such a configuration in defeating a specified target.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A warhead comprising:

a plurality of discrete fragments disposed in a matrix material comprising a reactive material, the plurality of discrete fragments and the matrix material being cooperatively shaped into a reactive material fragmentation body; and an explosive charge cooperatively configured with the reactive material fragmentation body to cause fragmentation of the matrix material upon detonation of the explosive charge, the explosive charge being further configured to fracture the matrix material so as to provide a plurality of reactive matrix material fragments and to propel the plurality of discrete fragments and the plurality of reactive matrix material fragments away from the warhead;

wherein the reactive material fragmentation body and the explosive charge are cooperatively configured so as to propel the plurality of discrete fragments at a first average velocity over a defined distance and to propel the plurality of reactive matrix material fragments at a second velocity over the defined distance, the second velocity being less than the first velocity.

2. The warhead of claim 1, wherein the plurality of discrete fragments comprises a plurality of discrete fragments each comprising an inert material.

3. The warhead of claim 2, wherein the reactive material of the matrix material comprises nickel, aluminum, potassium perchlorate and epoxy.

4. The warhead of claim 3, wherein the explosive charge comprises 2,4,6,8,10,12-hexanitrohexaazaisowurtzitane and hydroxyl-terminated polybutadiene.

5. The warhead of claim 4, further comprising a metal barrier disposed adjacent a portion of a surface of the reactive material fragmentation body.

6. The warhead of claim 4, wherein the plurality of discrete fragments comprises at least one of tungsten and steel.

7. The warhead of claim 1, wherein the reactive material comprises at least two substances capable of reacting with one another in an energetic reaction.

8. The warhead of claim 7, wherein the reactive matrix material fragments of the plurality are configured to react upon impact with an object after detonation of the explosive charge.

9. The warhead of claim 1, wherein the discrete fragments of the plurality comprise an inert material and the reactive material of the matrix material comprises at least two substances capable of reacting with one another in an energetic reaction.

10. A missile comprising:

a nose section;

a rocket motor;

a tail section; and a warhead, the warhead comprising:

a plurality of discrete fragments disposed in a matrix material comprising a reactive material, the plurality of discrete fragments and the matrix material being cooperatively shaped into a reactive material fragmentation body; and an explosive charge cooperatively configured with the reactive material fragmentation body to cause fragmentation of the matrix material upon detonation of the explosive charge, the explosive charge being further configured to fracture the matrix material so as to provide a plurality of reactive matrix material fragments and to propel the plurality of discrete fragments and the plurality of reactive matrix material fragments away from the warhead;

wherein the reactive material fragmentation body and the explosive charge are cooperatively configured so as to propel the plurality of discrete fragments at a first average velocity over a defined distance and to propel the plurality of reactive matrix material fragments at a second average velocity over the defined distance, the second average velocity being less than the first average velocity.

11. The missile of claim 10, wherein discrete fragments of the plurality comprise an inert material and the reactive material of the matrix material comprises at least two substances capable of reacting with one another in an energetic reaction.

* * * * *

UNITED STATES PATENT AND TRADEMARK OFFICE

CERTIFICATE OF CORRECTION

PATENT NO. : 7,614,348 B2
APPLICATION NO. : 11/512058
DATED : November 10, 2009
INVENTOR(S) : Richard M. Truitt et al.

It is certified that error appears in the above-identified patent and that said Letters Patent is hereby corrected as shown below:

| | | |
|---|---|---|
| COLUMN 3 | LINE 20 | change "the warhead of FIG. **2**" to --the warhead of FIG. **2A**-- |
| COLUMN 3 | LINE 22 | change "the warhead of FIG. **2**" to --the warhead of FIG. **2A**-- |
| COLUMN 4 | LINE 9 | change "the weapon" to --the weapon 100-- |
| COLUMN 8 | LINE 25 | change "5 $\mu$l+2Co, Al+Fe, 3 Al+Fe," to --5A1+2Co, Al+Fe, 3Al+Fe,-- |
| COLUMN 8 | LINE 26 | change "2 $\mu$l+3S," to --2Al+3S,-- |
| COLUMN 8 | LINE 32 | change "5Cr, 3Si, Fe, +Si," to --5Cr+3Si, Fe+Si,-- |
| COLUMN 8 | LINE 33 | change "3Si, +5Ti, 2Si, +V," to --3Si+5Ti, 2Si+V,-- |
| COLUMN 9 | LINE 50 | change "(6to" to --(6 to-- |
| COLUMN 10 | LINES 45-46 | change "hydroxyl-terminaterd" to --hydroxyl-terminated-- |

Signed and Sealed this
Twenty-eighth Day of December, 2010

David J. Kappos

David J. Kappos
*Director of the United States Patent and Trademark Office*